US008550250B2

(12) United States Patent
Wade

(10) Patent No.: US 8,550,250 B2
(45) Date of Patent: Oct. 8, 2013

(54) RECLOSABLE ONE TIME SECURITY TRAP SEAL BLISTER PACKAGE

(75) Inventor: Michael P. Wade, Chesterfield, VA (US)

(73) Assignee: MeadWestvaco Corporation, Richmond, VA (US)

( * ) Notice: Subject to any disclaimer, the term of this patent is extended or adjusted under 35 U.S.C. 154(b) by 82 days.

(21) Appl. No.: 13/235,915

(22) Filed: Sep. 19, 2011

(65) Prior Publication Data

US 2012/0085671 A1 Apr. 12, 2012

Related U.S. Application Data

(60) Provisional application No. 61/392,051, filed on Oct. 12, 2010.

(51) Int. Cl.
*B65D 73/00* (2006.01)

(52) U.S. Cl.
USPC ..... 206/562; 206/462; 206/467

(58) Field of Classification Search
USPC ..... 206/461, 462, 463, 467, 469, 470
See application file for complete search history.

(56) References Cited

U.S. PATENT DOCUMENTS

| | | | | |
|---|---|---|---|---|
| 3,246,747 | A * | 4/1966 | Blish | 206/462 |
| 4,083,451 | A | 4/1978 | Hair | |
| 4,724,964 | A | 2/1988 | Hernandez | |
| 5,012,927 | A | 5/1991 | Borst | |
| 5,788,105 | A * | 8/1998 | Foos | 220/266 |
| 6,053,321 | A * | 4/2000 | Kayser | 206/470 |
| 7,841,470 | B2 * | 11/2010 | Chin | 206/462 |
| 8,091,704 | B2 * | 1/2012 | Trigg | 206/469 |
| 2003/0217949 | A1 | 11/2003 | Schamante | |
| 2004/0040880 | A1 * | 3/2004 | Grosskopf | 206/461 |
| 2006/0016717 | A1 | 1/2006 | Ritter | |
| 2006/0213800 | A1 * | 9/2006 | Ballard et al. | 206/470 |
| 2007/0029223 | A1 | 2/2007 | Mazurek | |
| 2007/0051652 | A1 * | 3/2007 | Tilton | 206/462 |
| 2007/0062836 | A1 * | 3/2007 | Nazari | 206/461 |
| 2007/0125666 | A1 | 6/2007 | Nazari | |
| 2007/0289890 | A1 | 12/2007 | Appelbaum | |
| 2008/0029417 | A1 * | 2/2008 | Begim | 206/461 |
| 2010/0122923 | A1 | 5/2010 | Chin | |

FOREIGN PATENT DOCUMENTS

| | | | |
|---|---|---|---|
| DE | 9111978 | U1 | 12/1991 |
| WO | WO2006099201 | A1 | 9/2006 |
| WO | WO2010068593 | A2 | 6/2010 |

OTHER PUBLICATIONS

PCT/US2011/052107 International Search Report, mailed Dec. 16, 2011.
PCT/US20099/067004 International Search Report Jan. 20, 2011.

* cited by examiner

*Primary Examiner* — David Fidei
(74) *Attorney, Agent, or Firm* — MWV Intellectual Property Group

(57) ABSTRACT

A package is disclosed comprising a reclosable blister attached to a paperboard card.

13 Claims, 5 Drawing Sheets

FIG. 4A
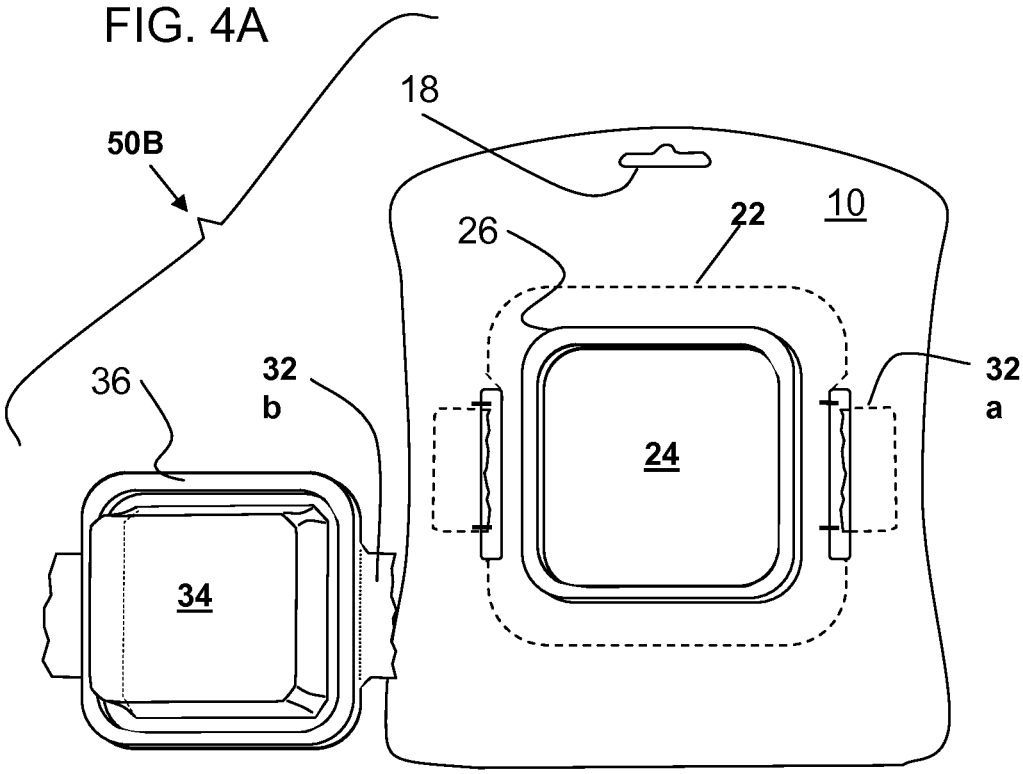
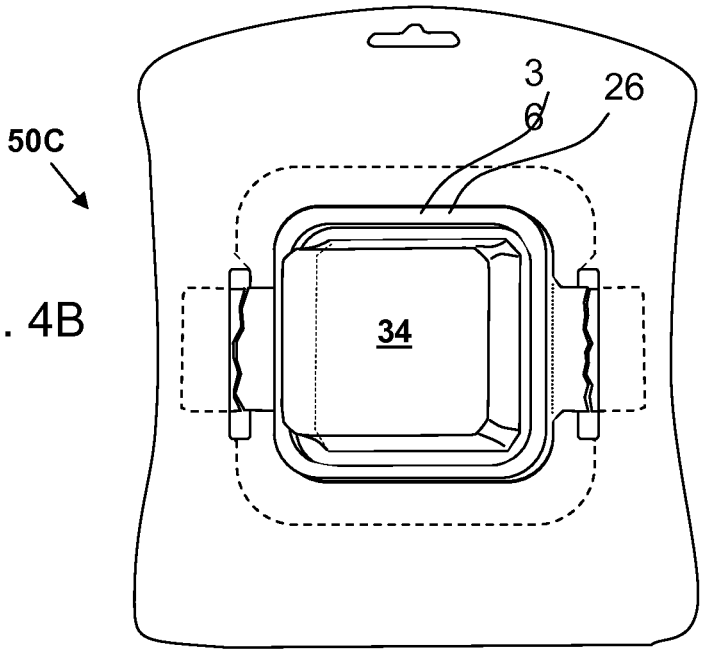
FIG. 4B

RECLOSABLE ONE TIME SECURITY TRAP SEAL BLISTER PACKAGE

REFERENCE TO RELATED APPLICATIONS

This application claims the benefit of priority under 35 U.S.C. §119(e) of U.S. provisional application Ser. No. 61/392,051 filed on Oct. 12, 2011 which is hereby incorporated by reference in its entirety.

BACKGROUND

The present application is directed to paperboard packages and, more particularly, reclosable security packages.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK® packages. Packaging made primarily of paperboard is more sustainable than packaging made from petroleum-based plastics. The paperboard used in such packages may be tear-resistant as described in commonly assigned U.S. Pat. No. 7,144,635.

Some blister packages may comprise a paperboard card and a blister. Especially when made with tear resistant paperboard, these packages can be quite secure and may require a tool such as a scissors or knife to open the package. Thus the secure structure of the packages may prevent in-store theft and tampering. However, after purchase, when the package has been cut to remove the product, the user may wish to still use the package around the house for occasionally storing the product. Such might be the case if the product is a small tool that is used occasionally, but is otherwise most conveniently kept in the package, for example due to safety reasons such as with replacement blades for a utility knife, or due to product protection for example with small flashlight bulbs that are easily lost or broken, or for orderly product storage, for example with many hardware items such as bolts, screws, etc which become lost or commingled if not kept in a package. If a security package has been cut open, it often becomes unusable or difficult to use for future storage of the product. Furthermore, even an unwanted product is returned to the retailer, the package may be damaged enough so that the retailer cannot sell it again (e.g. as discounted returned goods). It would be advantageous therefore to have a security package which, after opening, could still be returned to a closed configuration for containing its contents.

The current application discloses a security package which after being opened (that is, transitioned from a more secure retail configuration to a non-secure opened configuration), may still be closed to a less secure storage configuration.

SUMMARY

In one aspect a packaging structure is disclosed which comprises a first card and a second card comprised of sheet material, and a first blister sealed to or formed as part of at least one of the cards, and wherein the first card and the second card are sealed together along at least parts of their interfacing surfaces to provide a more securely closed configuration, said package including engagement features in the cards and blister which, after the package is opened from its more securely closed configuration, cooperate to allow the package to be held in a less securely closed configuration.

Other aspects of the disclosed packaging structures will become apparent from the following description and the accompanying drawings.

A reclosable feature is provided on a trap seal blister pack. The reclosable feature allows consumers the ability to handle a product before purchase (i.e. sizing, etc.), and to use the package for storage of the product after purchase. In another embodiment for retail security packaging, a one time secure opening feature is provided that requires a tool to open (scissors or knife), but once opened the package is still reclosable. This initial one time security feature would meet the requirements of retail loss prevention groups for initial security packaging requirements. Having a reclosable feature allows the product to be repackaged for store returns, making the package and product able to be redisplayed as saleable merchandise.

A two piece or hinged one piece thermoform blister may be used, which may fit between two cards or between the halves of a one-piece hinged card. The thermoform bottom portion may include a flange that may be trap sealed between two cards. The design of the bottom thermoform may include a tongue-in-groove or other form of mechanical locking mechanism that is compatible with a mating section of the upper hinged half, or the second thermoform. The second half or second thermoform would snap-fit in place to interlock both thermoform sections or parts together forming a display housing for the product. Such a package may be made secure by providing with top thermoform with die cut straps or bands extending from its edges that can be trap-sealed between the two sealable tear resistant cards during the package fulfillment process. These security straps or bands would then secure the thermoform halves together to form a security package for use in retail environments. Before the package was opened the first time, these bands could be cut (using a tool such as a scissors or knife), thus releasing the upper part of the thermoform to be moved away from engagement with the lower half After the bands or straps are severed the two thermoformed halves can still be reclosed using the mechanical engagement feature, such as the tongue and groove engagement.

The reclosable feature would allow a secure blister card to function similar to a snap lock thermoformed plastic clamshell. Using tear resistant board such as MeadWestvaco NATRALOCK® combined with the security strap or band closure referenced above provides a retail security package difficult to open without use of a tool such as a knife or scissors.

BRIEF DESCRIPTION OF THE DRAWINGS

FIG. 4A is a top perspective view of the package having been opened;

FIG. 4B is a top perspective view of the package reclosed; and

DETAILED DESCRIPTION

Figure 1:
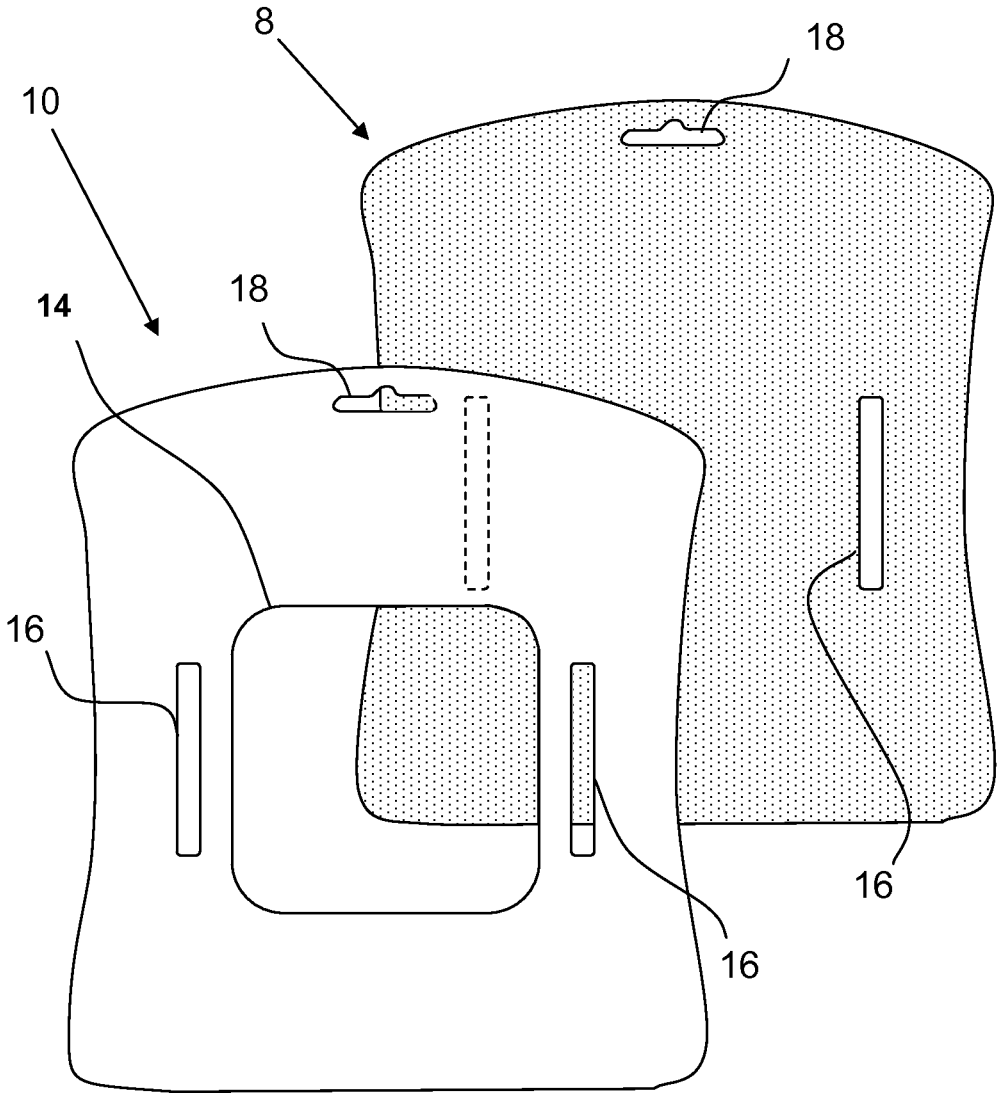
FIG. 1 is a top perspective view of cards for forming a packaging structure.

As various embodiments of the security package are described, reference will be made to FIGS. 1-5. Certain parts of the packages are denoted by reference numerals. Where there is more than one of the same feature, sometimes only one will be denoted by a reference numeral. If different packages have a common feature, it may only be described one time. Typically in these Figures, solid lines show edges, while dashed lines show hidden or partially obscured features.

Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. In most cases the packages described here are made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

FIG. 1 shows a top perspective view of a front card 10 and rear card 8 for forming a security package. An aperture 14 may be provided in the front card, to receive a blister as described below. Although not shown here, rear card 8 may also include an aperture for receiving a blister. One or more access slots 16 may be provided in one or both cards, whose use will be explained below. Hang holes 18 may be provided on one or both cards. Although front card 10 and rear card 8 may be provided separately as shown, they may also be provided as a single piece, for example, with the front card 10 and rear card 8 joined along a hinge or fold line. The cards may be made of a sheet material such as paperboard, or of a tear-resistant paperboard such as MeadWestvaco NATRALOCK®.

Figure 2A:
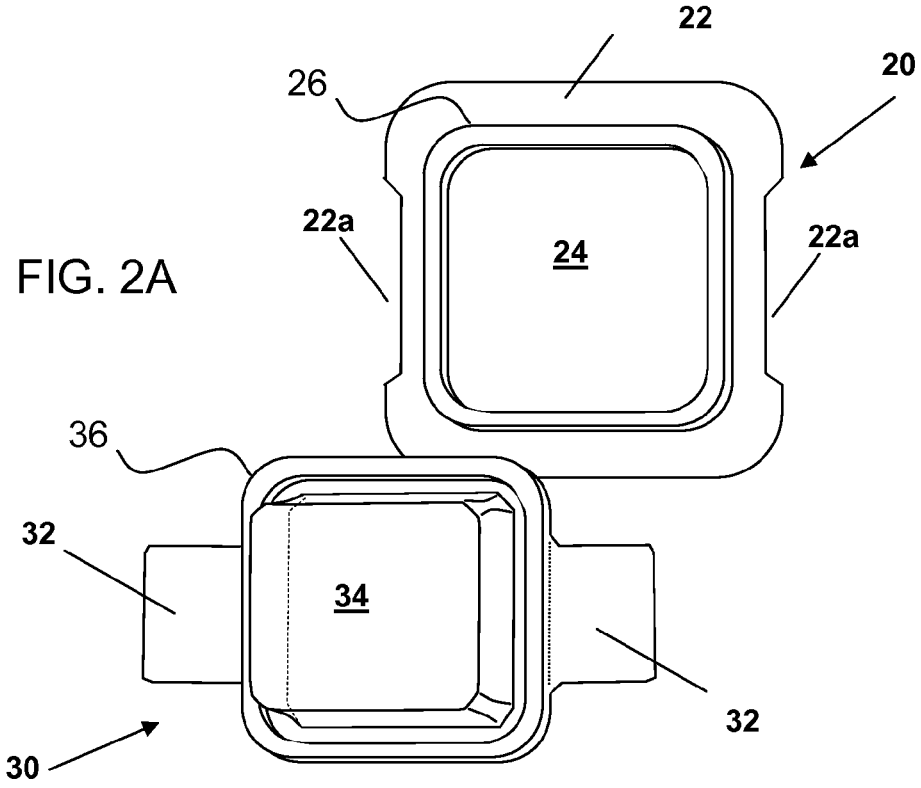
FIG. 2A is a top perspective view of parts for making a blister for use with the cards of FIG. 1.

FIG. 2A shows a rear blister portion 20 and a front blister portion 30, separated from one another. The blister may be made with common thermoform plastics such as PVC (polyvinyl chloride) or APET (amorphous polyethylene terephthalate) but may also include a recycled material such as RPET (recycled polyethylene terephthalate) or a biodegradable material such as PLA (polylactic acid). However other materials including other plastics or paperboard may also be used. The rear blister portion 20 may include a peripheral sandwich flange 22 that may have optional clearance indents 22*a*. The rear blister portion may also include a rear mating flange 26, for example forming an upstanding channel. The rear blister may comprise a flat backplane 24 or (not shown) may itself have a containment volume disposed to protrude through an aperture (not shown) in the rear card. However, the area of backplane 24 may in some cases be omitted, for example to save plastic. In such cases, the rear card may provide the back wall of the containment volume.

FIG. 2A also shows that front blister portion 30 may include a containment volume 34 surrounded by a front mating flange 36, for example forming an upstanding channel whose interior is shaped to closely receive the exterior of rear mating flange 26. The mating flanges may thus form a "tongue-in-groove" connection. The front blister portion 30 may also include one or more wing portions 32.

Figure 2B:
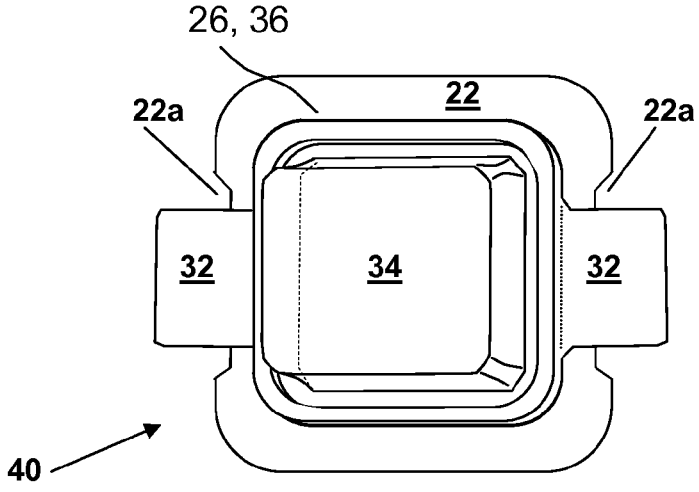
FIG. 2B is a top perspective view of the parts of FIG. 2A combined to form a blister.

FIG. 2B shows a closed blister 40 formed by combining rear blister portion 20 and front blister portion 30, for example by joining rear mating flange 26 and front mating flange 36 (for example, forming a tongue-in-groove connection). Side wings 32 may coincide with optional clearance indents 22*a*.

Figure 3:
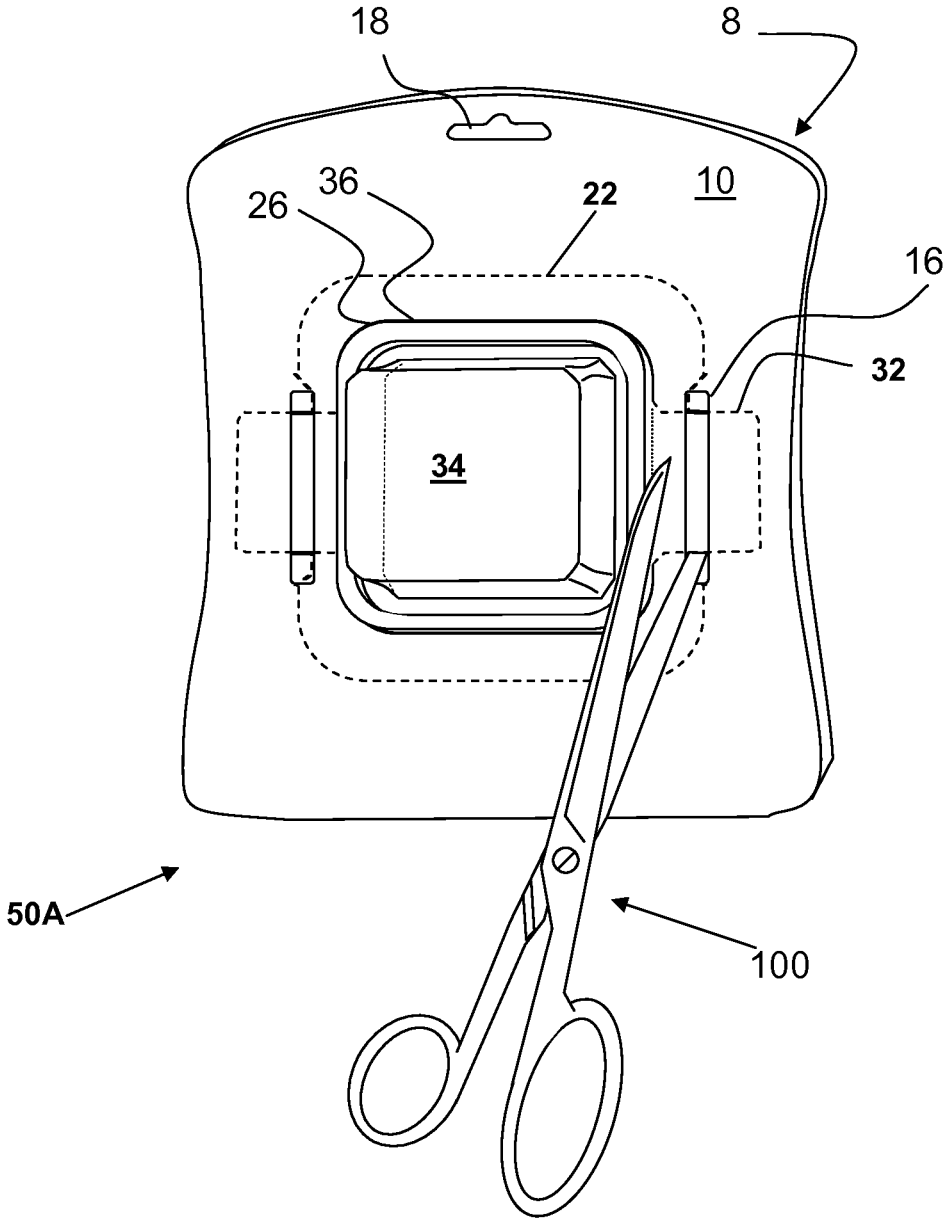
FIG. 3 is a top perspective view of the cards and blister combined to form a finished package; and a method for opening the package.

Blister 40 may be sandwiched between rear card 8 and front card 10 to form a securely closed package 50A as seen in FIG. 3. The cards may be joined together by heat sealing, RF (radio frequency) sealing, ultrasonic sealing, adhesive, or other means. The rear blister sandwich flange 22 may be securely sandwiched between the front card 10 and rear card 8. The side wings 32 may also be securely sandwiched between the cards. With the side wings 32 thus secured, and the rear mating flange 26 and front mating flange 36 joined together, the blister is securely held closed. The rear blister portion may be securely held around its periphery by sandwich flange 22 being trapped between rear card 8 and front card 10. The front blister portion may lack a sandwich flange, and thus may be securely primarily by the distal (outward or furthest from the containment volume 34) parts of side wings 32 being trapped between rear card 8 and front card 10. The proximal (inward or closest to the containment volume) parts of side wings 32 may be somewhat less tightly trapped; for example less or no heat sealing or adhesive may be applied to the proximal parts of side wings 32.

Particularly if the rear card 8 and/or front card 10 are made from a tear resistant material, it may be advantageous to use a tool such as a knife or scissors 100 to open package 50A. As shown in FIG. 3, the package may be opened by cutting at least one of side wings 32 where they are exposed through access slots 16. Clearance indents 22*a* may be provided on the sandwich flange 22 to make it easier for a cutting tool to reach or cut side wings 32. If multiple (for instance two) side wings 32 are utilized, it may be easier to open package 50A if both or all of the side wings 32 are cut where they pass through access slots 16. However, one or more of the side wings may optionally be left intact to serve as a "hinge" connecting the front blister portion 30 and rear blister portion 20. If the access slots 16 are omitted, the side wings 32 may be cut just inside aperture 14, that is, where the side wings attach to front mating flange 36.

Once at least one of side wings 32 are cut free, the front blister portion including containment volume 34 may be pulled forward, releasing the front mating flange 36 from rear mating flange 26, so the contents of the package are accessible. Such an open package 50B is shown in FIG. 4A, where both of the two side wings have been cut, leaving cut stubs 32*a*, 32*b*. The front blister portion is thus freed from the remainder of the package. However, if only one side wing was severed, the front blister portion although open may still be hingedly attached to the rear blister portion.

Although the more secure nature of package 50A may be lost by cutting side wings 32, and giving open package 50B, this package may yet be reclosed to a reclosed package 50C shown in FIG. 4B. This may be accomplished by again superimposing the front blister portion over the rear blister portion, so the front mating flange 36 once again joins to rear mating flange 26. Thus re-assembled, reclosed package 50C is suitable for storing the package contents (or other items) in a closed package. If the purchaser returns the package to the retailer, the retailer may be able to return the package to inventory (for example as discounted "returned/opened goods") since the reclosed package 50C (with or without additional measures such as taping) still provides a very sturdy package.

Figure 5:
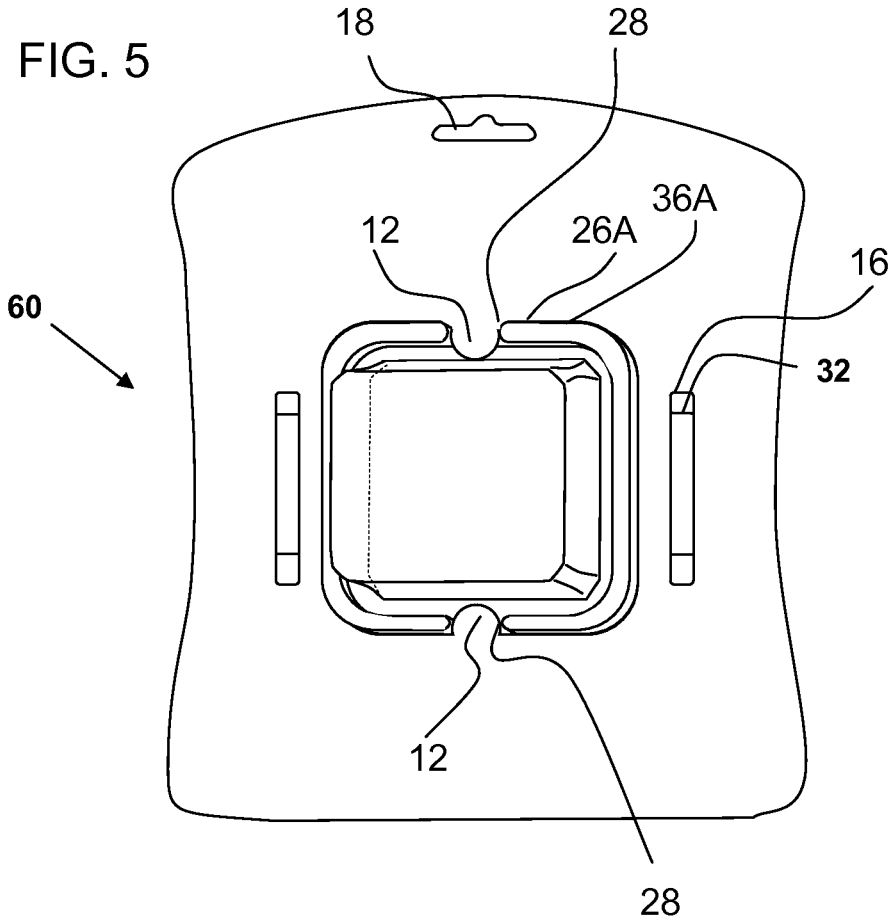
FIG. 5 is a top perspective view of an alternative package.

FIG. 5 shows another example of a reclosable package 60. The package is similar in many ways to the package already described. However, the rear mating flange 26A and front mating flange 36A are discontinuous, that is, have one or more gaps 28. At these gaps, latch tabs 12 of front card 10 may overlap a portion of the front blister periphery, to help hold the blister portions together initially, or after reclosing.

The cards 8, 10 may be formed of a sheet material such as paperboard, which may be made of or coated with materials to increase its strength. An example of such a sheet material is NATRALOCK® paperboard made by MeadWestvaco Corporation. The sheet material may have a heat sealable coating, for example to allow a heat seal to be created between the rear card 8 and front card 10. Alternately, other forms of adhesive may be used to seal these cards together. It should be noted that the use of tear resistant materials, and/or in more than one layer, help to improve the tamper- and theft-resistance of the package.

The adjoining surfaces of front card 10 and rear card 8 may be adhered together by heat sealing, RF sealing, ultrasonic sealing, gluing, or other adhesive. Rear card 8 and front card 10 may, for example, be paperboard. The cards are shown with substantially the same perimeter, which may yield a package comprised of two layers of paperboard. However, portions of the package might only be single ply. A more secure package may result if the rear blister sandwich flange 22 is sandwiched between two layers of material. One or both panels may comprise hang hole 18, or it may be reinforced with additional layer.

Heat sealing may be accomplished by use of both heat and pressure. Heat sealing may be used at the juncture of sandwich flange 22 with the front card 10 and rear card 8. Heat sealing may also be used along the periphery of front card 10 and rear card 8. Alternately heat sealing may be used on the entire adjoining surfaces of front card 10 and rear card 8, including the sandwich flange 22. However, as described earlier, less or no sealing may be practiced on the proximal portions of side wings 32.

The features described in this application may be used alone or in combination with other described standing features or security features. It is to be understood that a variety of materials may be used to form these packages. However, for sustainability purposes, a paperboard based material may be used and for improved theft deterrence a tear resistant paperboard may be used. Package materials may include tear-proof materials such as DURAFOLD® paperboard, tear-resistant materials such as NATRALOCK® paperboard, as well as other types of paperboard or plastic materials. The packages may be made of one or more layers of material, including but not limited to one, two, three or more layers of material. Different parts of the packages may comprise different materials and/or different numbers of layers.

The packages disclosed herein may be comprised mostly of paperboard, for example as described in International Application PCT/US08/051245. The paperboard used in such packages may be tear-resistant as described in commonly assigned U.S. Pat. No. 7,144,635.

The packages disclosed herein may be made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

It is to be understood that certain packages may be one continuous piece of material, and other packages may comprise two or more pieces of material. It is to be understood that a package may be heat sealed even where a heat sealed surface is in contact with a non-heat sealable surface. It is to be understood that in such a situation such an adhesion will strengthen the package, though it may not strengthen it as much as heat sealing between two heat sealable surfaces.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

Portions of the packages may be made of one, two, or more layers of material. It is to be understood that additional layers of material may be used based on manufacturing preferences. Portions of certain cards may be folded over or around the portions of other cards, creating multiple layers of material.

It should be understood that additional foldover cards may be included in the package blanks for further reinforcing the packages.

Those skilled in the art will appreciate that the disclosed blister packaging structures may provide a theft deterrent function at least for a few moments, while providing legitimate consumers with packages easy to open in a reasonably short time, for example using a pair of scissors and reducing the risk of injury as the scissors are less likely to slip on the NATRALOCK® or paperboard like material than on the plastic blister pack.

To provide additional tear resistance protection, any of the materials used in these designs could be provided with overt or hidden features such as nicks, scores, perforations, holes, or other diverting features such that if a tear is initiated in the packaging material, it will not propagate in a direction more likely to breach the package, but may be rerouted by the diverting feature or features in a direction less likely to breach the package. Alternately the diverting feature may stop the tear, slow the progression of the tear, or cause it to take a meandering path, thus lengthening the time it may take to eventually breach the package, and thereby discouraging a thief. Certain tear-diverting features are described in U.S. Provisional Application No. 61/081,404.

It is to be understood that a variety of standing features or a variety of hanging features may be used on any of these package designs as determined by manufacturing preferences. One or more reinforcing layers of paperboard or other material may be placed between layers of a package, for example between the front and rear cards of a card-type package, for example at the hang hole location, as described in PCT/US08/066517. Although various aspects of the disclosed blister packaging structures have been shown and described, modifications may occur to those skilled in the art upon reading the specification.

The invention claimed is:

1. A packaging structure comprising:

a front card and a rear card comprised of sheet material, a blister rear portion comprising a sandwich flange;

a blister front portion comprising at least one side wing;

wherein the front and rear cards are sealed together;

wherein the sandwich flange is trapped between the front and rear cards;

wherein for a securely closed configuration the at least one side wing is trapped between the front and rear cards and holds the front and rear blister portions together;

wherein an access slot is provided in said rear card, said access slot overlapping a portion of said at least side wing; and wherein cutting said at least one side wing permits the blister front portion to be separated from the rear blister portion.

2. The packaging structure of claim 1, wherein the blister rear portion comprises a rear mating flange and the blister front portion comprises a front mating flange, and the front and rear mating flanges cooperate to hold the front and rear blister portions together.

3. The packaging structure of claim 2, wherein after cutting said at least one side wing, said packaging structure may still be reclosed by rejoining said front and rear mating flanges.

4. The packaging structure of claim 1, wherein a clearance indent is provided in said sandwich flange, said clearance indent overlapping a portion of said at least one side wing.

5. The packaging structure of claim 1, wherein at least one of said front and rear cards comprises a back layer and a front layer.

6. The packaging structure of claim 1, wherein the front card comprises a first aperture through which the blister extends.

7. The packaging structure of claim 1, further comprising a hang hole.

8. The packaging structure of claim 1, further comprising an overt or hidden tear diversion feature.

9. The packaging structure of claim 1, wherein at least one of said cards comprises a tear-resistant paper or paperboard.

10. The packaging structure of claim 1, wherein at least one of said blister front and rear portions comprises recycled polyethylene terephthalate or polylactic acid.

11. A method of forming a package, the method comprising:

providing a front card having an aperture, providing a rear card, providing an access slot in said rear card;

providing a blister rear portion having a sandwich flange;

providing a blister front portion having at least one side wing;

placing the blister rear portion and blister front portion between the front card and the rear card so that the blister front portion extends through the aperture and said access slot overlaps at least a portion of said at least one side wing;

sealing the front and rear cards together to trap the sandwich flange and at least one side wing between the front and rear cards.

12. The method of claim 11, further comprising the additional subsequent step of severing the side wing to permit separating the blister front and rear portions.

13. The method of claim 11, further comprising providing a first mating flange on the rear blister portion and a second mating flange on the front blister portion.

* * * * *